US005588547A

United States Patent [19]

Derksen

[11] Patent Number: 5,588,547

[45] Date of Patent: Dec. 31, 1996

[54] COVERING DEVELOPED FOR INFUSION BOTTLE

[75] Inventor: Klaus Derksen, Karlsbad-Ittersbach, Netherlands

[73] Assignee: Carl Freudenberg, Weinheim, Germany

[21] Appl. No.: 337,675

[22] Filed: Nov. 10, 1994

[30] Foreign Application Priority Data

Dec. 9, 1993 [DE] Germany ..... 43 44 134.3

[51] Int. Cl.[6] ..... B65D 41/58

[52] U.S. Cl. ..... 215/247; 215/277; 215/347

[58] Field of Search ..... 215/247, 249, 215/251, DIG. 3, 277, 320, 341, 347, 353, 364, 325, 324; 220/254, 257, DIG. 19, 256, 258

[56] References Cited

U.S. PATENT DOCUMENTS

| | | | |
|---|---|---|---|
| 1,814,650 | 7/1931 | Waite | 215/247 X |
| 2,236,491 | 3/1941 | Campbell | 215/249 |
| 2,561,294 | 7/1951 | Schuler | 215/247 |
| 2,629,379 | 2/1953 | Fields | 215/247 X |
| 2,734,649 | 2/1956 | Callahan et al. | 215/249 X |
| 2,906,423 | 9/1959 | Sandhage | 215/249 |
| 3,013,687 | 12/1961 | Gould | 215/249 |
| 3,047,178 | 7/1962 | Poitras et al. | 215/249 X |
| 3,067,898 | 12/1962 | Reimann | 215/249 |
| 3,904,059 | 9/1975 | Bellamy, Jr. et al. | 215/247 |
| 3,959,061 | 5/1976 | Renck et al. . | |
| 4,205,754 | 6/1980 | Nielsen . | |

FOREIGN PATENT DOCUMENTS

| | | |
|---|---|---|
| 0196591 | 10/1986 | European Pat. Off. . |
| 0242453 | 10/1987 | European Pat. Off. . |
| 1071650 | 9/1954 | France . |
| 2210552 | 7/1974 | France . |
| 7212134 | 3/1973 | Netherlands . |

*Primary Examiner*—Allan N. Shoap
*Assistant Examiner*—Nathan Newhouse
*Attorney, Agent, or Firm*—Martin A. Farber

[57] ABSTRACT

A covering (A) which is developed as closure for infusion bottles (3) or the like, having a cap (1) adapted to be flanged at its lower edge (11) onto the neck (2) of the bottle, the cap having a hole (9) in its top (8) for the formation of a puncture region, and in order to obtain a structural shape which is of simpler manufacture and more favorable for disposal, the hole (9) is closed by the foil section (16) of a supplementary cap (17) which, as a result of that fact that it extends to the lower edge (11) of the cap (1), can be flanged with the latter and is attached by adherence to the cap (1).

8 Claims, 4 Drawing Sheets

COVERING DEVELOPED FOR INFUSION BOTTLE

FIELD AND BACKGROUND OF THE INVENTION

The present invention relates to a covering developed as closure for infusion bottles or the like, which has a cap adapted to be flanged at its lower edge on the neck of the bottle, the cap having a hole in its cover for the forming of a puncture region.

A closure of this type is known from U.S. Pat. No. 4,205,754. The cap, which is substantially of cup shape, serves to hold a stopper which closes the mouth of the bottle. The stopper rests via a peripheral annular flange on the front surface of the mouth of the bottle neck. In this case, the top of the cap, which has a central hole, extends over the top of the stopper while the radially inwardly flanged lower edge of the cap grips in fastening manner behind a collar which is formed on the outside of the region of the mouth of the neck of the bottle. A top cap is furthermore associated with this closure. In this way, contamination of the stopper which consists, for instance, of rubber is avoided. Such a top cap consists of plastic, while the flangeable material of the cap consists of plastically deformable metal. The cap is anchored by undergripping in the region of the rim of the hole. It is removed in order to puncture the stopper, for instance by means of an injection needle. The manufacture of such a closure is relatively expensive and, in the event of proper waste disposal, results in three types of material.

SUMMARY OF THE INVENTION

The object of the present invention is to develop a closure of this type which is simpler to manufacture and more favorable with regard to disposal.

As a result of the development of the invention, a closure which is substantially easier to manufacture is produced. The top cap as injection molding is done away with. Its special undergripping arrangement at the rim of the hole is also eliminated, these previous measures having required too great an expense for a mass-produced article. Furthermore, the hole provided for the piercing by an injection needle or the like is reliably closed. For this, a film section made of a film obtainable on the market is used. It is developed as a supplementary cap and is associated with the flangeable cap proper, i.e. the self-supporting cap. It is connected by adherence with it. It can thus be stored as a unit. The internested dished caps cannot fall apart. Upon the capping, the supplementary cap is included in the flanging, since its edge also extends to the lower edge of the cap and therefore is included in the fastening measure in question. Not only the puncture region but the entire free portion of the stopper is protectively covered and therefore protected from contamination and the formation of germs. In this connection, it has furthermore proven advantageous for the adherent attachment to be provided in the region of the lower edge. A clamping attachment may be present. It is even better if the adherent attachment is obtained from the formation of an edge burr upon the deep-drawing of the two caps in a single operation. For this purpose, ordinary tools can be used. It is furthermore proposed that the two-layer edge be bent off outwards and be adapted to be folded in the opposite direction in the flanging process. This leads to an extremely firm anchoring of the corresponding laminate-like structure.

One advantageous method of producing a covering in accordance with the invention is thus characterized by the fact that two strips of deep-drawable material come together in overlapping position below a deep-drawing stamp of a deep-drawing tool which transforms both strips into a cap-like structure and cuts them off on the edge producing an edge-burr formation as adherent attachment of the two cap parts. The stamped product is thus imparted an attachment which excellently withstands the ordinary mechanical stresses, for instance those produced by feeding and aligning devices. A particularly economical method is present if the deep-drawing tool stamps a hole with a punch into the one section of material before the deep-drawing. Such a hole can even be used in the deep-drawing station for centering in position in the manner that a leading alignment pin enters therein.

BRIEF DESCRIPTION OF THE DRAWINGS

With the above and other and other advantages in view, the present invention will become more clearly understood in connection with the detailed description of a preferred embodiment, when considered with the accompanying drawings of which.

Figures 1, 2:
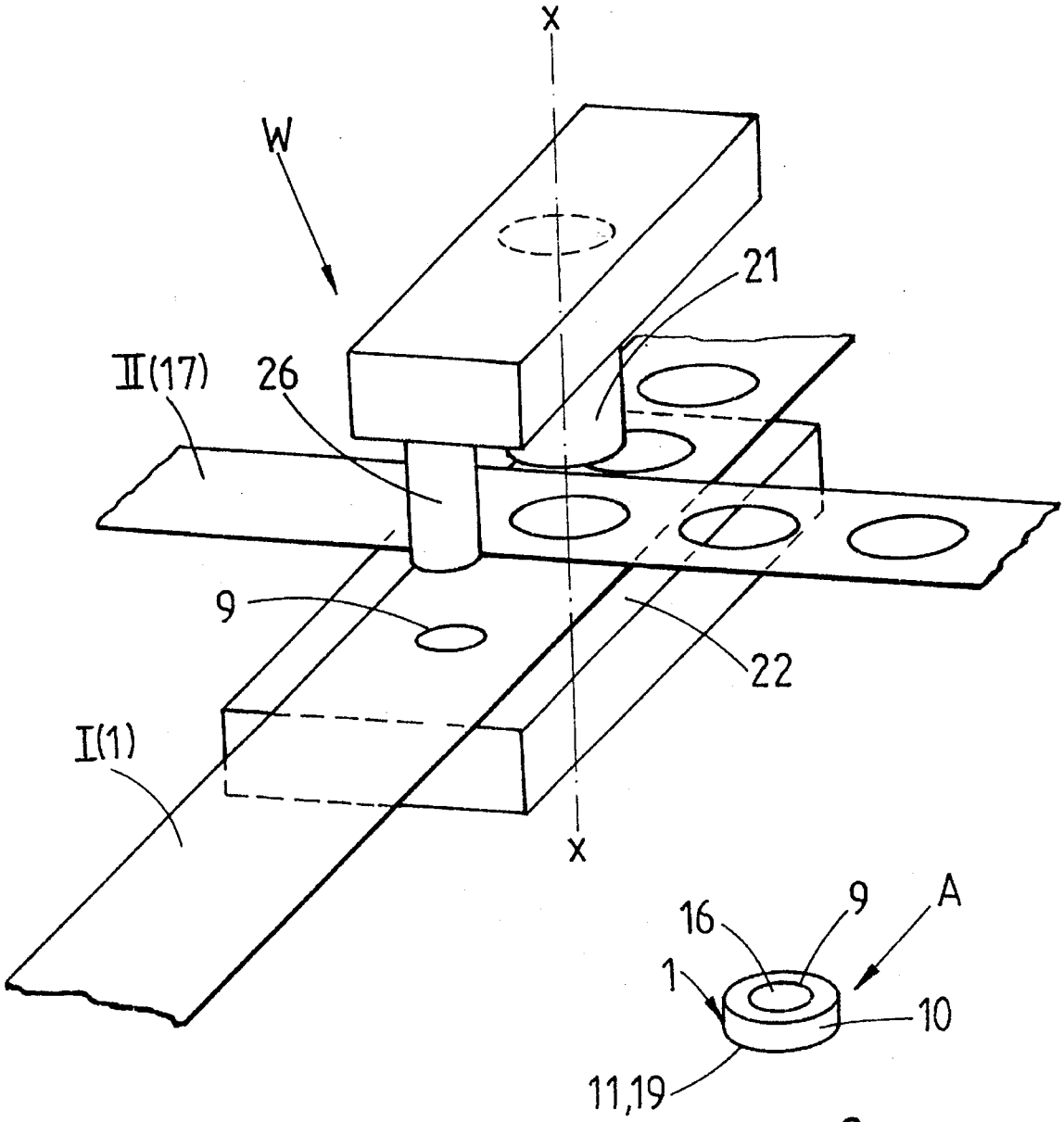
FIG. 1 shows, in perspective, the deep-drawing tool for the production of the closure in accordance with the invention, it indicating the crosswise position of the strips, the figure being very diagrammatic.
FIG. 2 shows, also in perspective, the closure produced in upside-down position as compared with the position in which it drops out.
Figure 3:
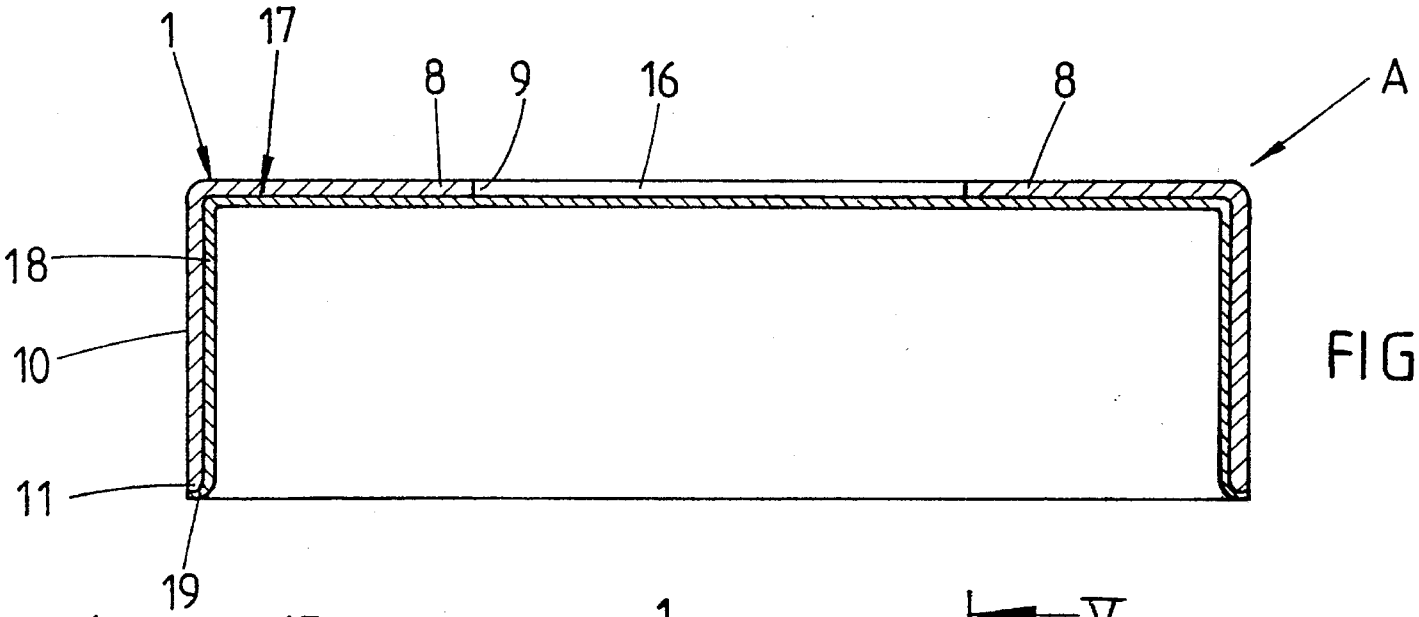
FIG. 3 is a considerably enlarged, vertical section through the closure.
Figure 4:
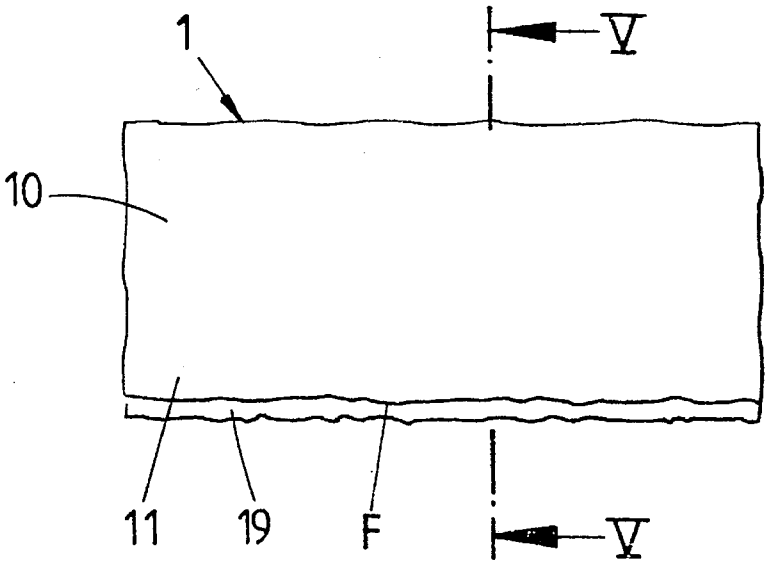
FIG. 4 shows an enlarged portion of the outer wall, at a place in the vicinity of the edge.
Figure 5:
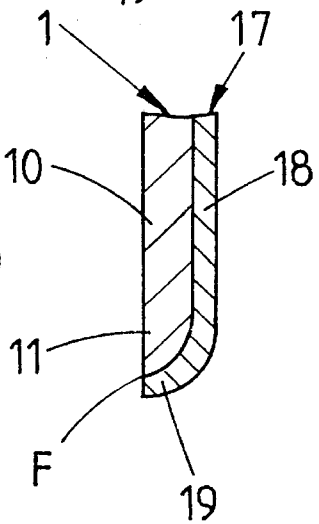
FIG. 5 is a cross section along the line V—V of FIG. 4.

The closure of the invention forms a cover A. A flangeable cap 1 is part thereof.

For the corresponding plastic deformation, recourse is preferably had to aluminum.

For the flanged undergripping, the neck 2 of a bottle 3, preferably an infusion bottle, forms a collar 4 which protrudes with rotational symmetry on the outside of the neck 2. The collar lies in the region of the mouth 5 of the bottle 3. The bottle consists, for instance, of glass.

The mouth 5 receives a puncturable closure member in the form of a stopper 6. The stopper 6, which consists of elastomeric material such as butyl rubber, is hollowed in dome-like manner in the region of its shank. The cavity bears the reference numeral 7. It faces the inside of the bottle 3 and results in a reduction in the thickness in the top section of the hollow stopper-like closure member which is favorable for puncturing.

Figure 7:
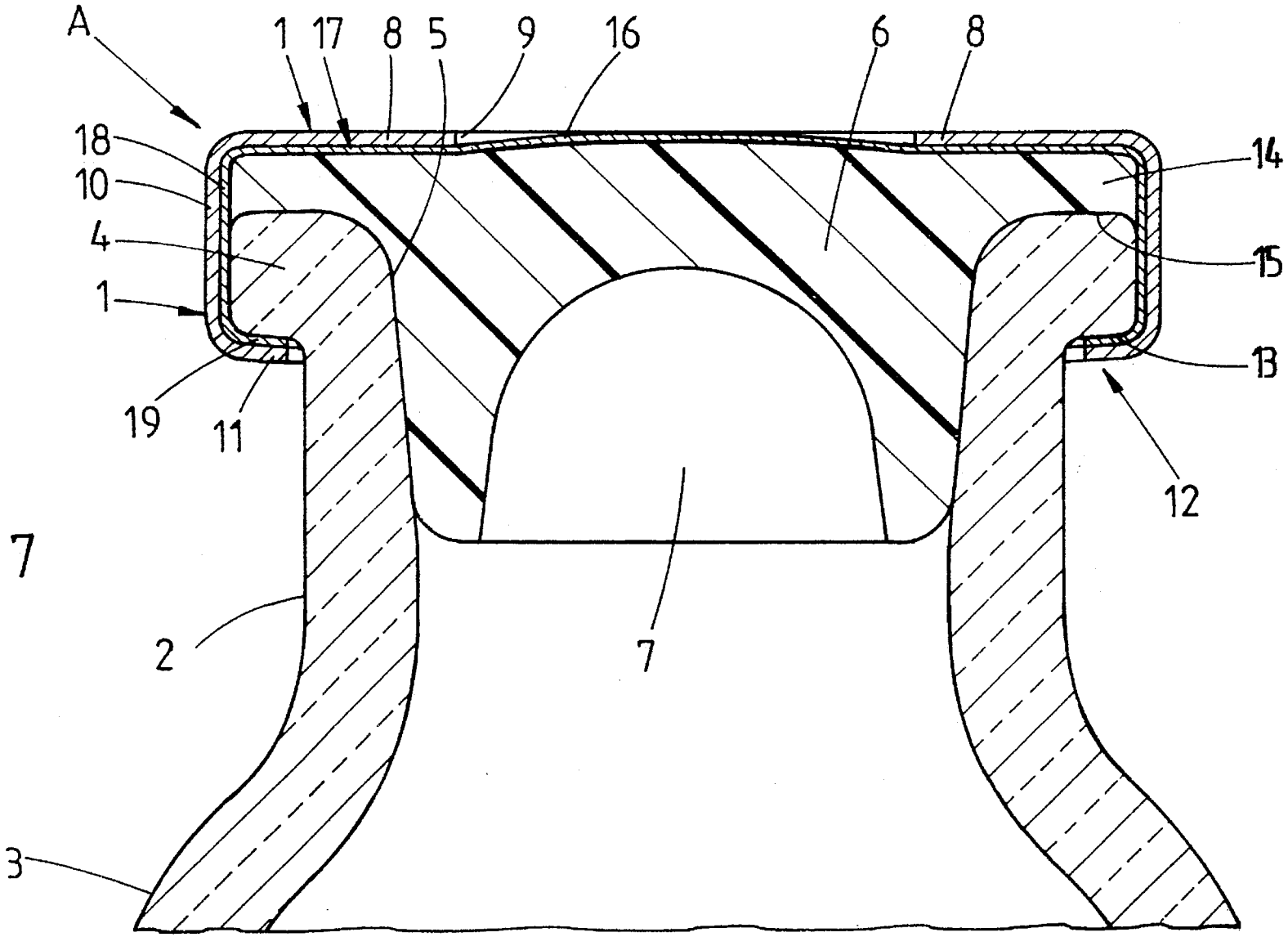
FIG. 7 is a vertical section through an infusion bottle provided with the closure in accordance with the invention, only the neck of the bottle being shown.

For piercing by the cannula of an infusion set, transfusion set, hypodermic needle, etc., the region of the cap 1 which forms a top 8 leaves a corresponding puncture region developed as hole 9. The inside diameter of the hole is somewhat less than the diameter of the mouth 5 and corresponds approximately to the largest diameter of the cavity 7. The puncture is thereby directed into the thinned region of the stopper 6. To this extent there furthermore remains sufficient material for the formation of the top 8, which continues, via a substantially cylindrical cap wall 10, into a lower edge 11 which, as shown in FIG. 7, forms the so-called flange edge 12. The edge is bent radially inward and extends below the lower, substantially horizontal, flank 13 of the collar 4. In this way, an annular flange 14 which is formed on the periphery of the stopper 6 is pressed firmly, in sealing manner, against the upper front surface 15 of the bottle neck 2. The front surface 15 passes via a convex transverse curvature into the mouth 5 of the bottle neck 2.

In order to avoid the partial exposure as a result of the hole of the free section of the stopper 6 and thus also exclude any contamination by or penetration of dirt, measures are taken in the direction for the covering of the stopper.

Specifically, this has the form that the hole 9 is closed by a foil section 16 of a supplementary cap 17. It can also consist of aluminum. An extremely slight thickness which can easily be punctured by the cannula is sufficient here, while the flangeable cap 1 has a thickness which permits the corresponding plastic deformation and the desired firm clamping of the annular flange 14, which acts as a sealing ring.

The supplementary cap 17 can be inserted into the cap 1. Its substantially cylindrical cap wall 18 extends also to the lower edge 11 of the cap 1. The lower edge of the supplementary cap 17 bears the reference numeral 19. The latter is included in the flanging.

Figure 6:
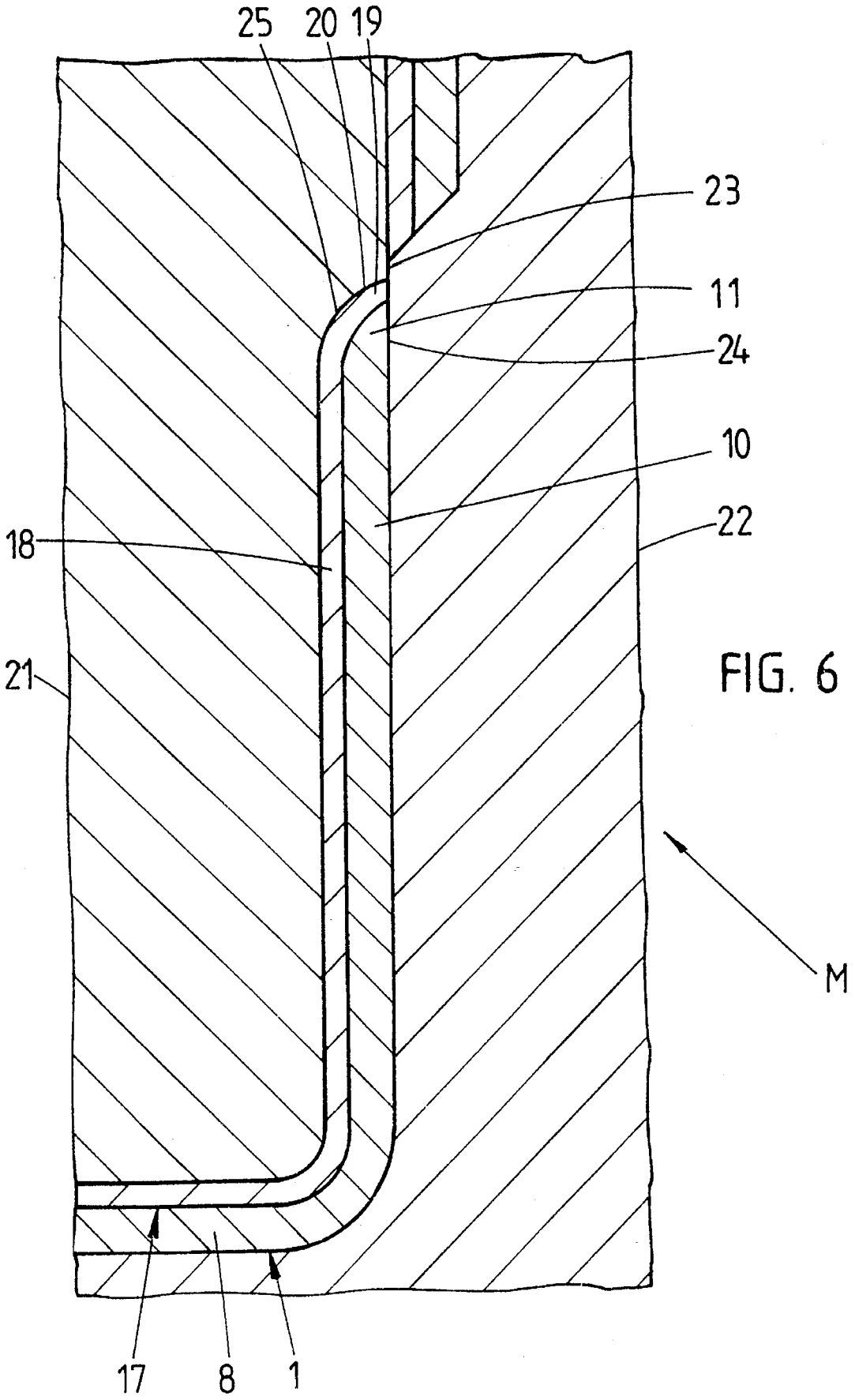
FIG. 6 shows the edge portion of the closure at the end of the deep-drawing process and upon the conclusion of the formation of the edge burr, shown greatly enlarged in vertical cross section.

Cap 1 and supplementary cap 17 are secured in their internested position by an adherence attachment. It may be a friction-lock adherence attachment which holds the internested "cups" together. Preferably, however, the adherence attachment is produced in the region of the joint lower edges 11/19, namely as a result of the joint deep-drawing of the two caps, namely the cap 1 and the supplementary cap 17. This is done in a single operation. The adherence attachment results in the course of the cutting of the double-layer edge to basically the same length (see FIG. 6). In this connection, the double-layer edge 11/19 is bent off outwards. This is effected at least with respect to the material of the edge 19 of the supplementary cap 17, namely by gripping below the end edge 11. By the corresponding die, it is possible to effect a drawing into the shape of a hat beyond the edge region shown as undergrip 20. The tendency of the outward curvature is present in this way, or else otherwise, with respect to the lower edge 11 of the cap 1. At least the edge 11 is pointed bent in wedge shape to the wall of the entire cap 1/17.

Brought into the so-called flange position, an opposite, radially inwardly directed folding then takes place during the course of the process (see FIG. 7).

The corresponding double-cap manufacturing process will be explained below with reference in particular to FIG. 1. That figure shows a deep-drawing tool W consisting of an upper deep-drawing stamp 21 and a deep-drawing die 22. The deep-drawing stamp 21 moves with cyclic control up and down in a vertical line x—x. Over the work table of the deep-drawing die 22 there extend two strips I, II of suitably deep-drawable material. The strips I, II cross each other. There is a right-angle feed. Upon the lowering the deep-draw stamp 21, the two strips I, II are simultaneously transformed into a cap-shaped structure in the same direction. Shortly before the end of the deep-drawing process, the desired adherence attachment is produced between the two caps 1, 17 by the formation of an edge burr, namely at a point of cutting 23 between the product and the waste material of the strips I, II. The formation of the edge burr is of such a nature that, aside from the cutting, there is a squeezing of the material between a wall portion 24 of the deep-drawing die 22 and a concavely curved step 25 of the deep-drawing stamp 21. The materials penetrate somewhat into one another in an irregularly undulated joint F, which leads even to under-cut situations. In any event, the adherence attachment thus obtained is sufficient. Special fastening aids are therefore unnecessary.

The method is furthermore also extremely economical, since the deep-drawing tool W, by a punch 26, punches the hole 9 in the one section of material, and therefore the strip I forming the outside cap 1, in a station prior to the deep-drawing.

Summarizing, extremely simple manufacture is thus obtained. The process commences in the manner that the strip material intended for the production of the flangeable, thicker cap 1 is punched and then deep-drawn, the foil section which closes the hole, and therefore the supplementary cap 17, being included, in cap-forming manner, in this deep-drawing.

From the standpoint of waste disposal, there are obtained, with respect to the cover A, only two types of material, namely cap 1 and supplementary cap 17, both of aluminum, and the stopper 6 of rubber.

I claim:

1. A covering for closing an infusion bottle, the covering comprising:

a first cap flanged at its lower edge for gripping a neck of the bottle, the first cap having a hole in its top for the information of a puncture region;

a supplementary cap comprising a pierceable foil and being enclosed by the first cap, the foil including a foil section;

wherein the hole is closed by the foil section of the supplementary cap;

the foil of the supplementary cap extends to the lower edge of the first cap and within the lower edge of the first cap to be flanged with a flange of the first cap;

the foil section of the supplementary cap has a thickness enabling a puncturing of the foil section, the foil being secured to the first cap by an adherence attachment; and the adherence attachment comprises a formation of edge burrs having an intermeshing of the foil of the supplementary cap with the flange of the first cap.

2. A covering according to claim 1, wherrein the adherence attachment is present in the region of the lower edge of the first cap.

3. A covering for closing an infusion bottle, the covering comprising:

a first cap flanged at its lower edge for gripping a neck of the bottle, the first cap having a hole in its top for the formation of a puncture region;

a supplementary cap comprising a pierceable foil and being enclosed by the first cap, the foil including a foil section;

wherein the hole is closed by the foil section of the supplementary cap;

the foil of the supplementary cap extends to the lower edge of the first cap and within the lower edge of the first cap to be figured with a flange of the first cap; and the foil section of the supplementary cap has a thickness enabling a puncturing of the foil section, the foil being secured to the first cap by an adherence attachment; and the flange of the first cap and a flange of the supplementary cap constitute a two-layer edge which is bent-off, the supplementary cap being tapered towards an outer surrounding wall of the first cap.

4. A covering according to claim 2, wherein the adherence attachment is a corrugated joint.

5. A covering according to claim 3, wherein the adherence attachment is a corrugated joint comprising a layer of material of the first cap contiguous the foil of the supplementary cap.

6. A covering according to a claim 3, wherein the adherence attachment is present in the region of the lower edge of the first cap.

7. A container comprising an infusion bottle having a neck, and a covering for closing off an opening in the neck, wherein the neck has a collar, and the covering has a lower edge configured for mating with the collar for securing the covering to the neck; and wherein the covering comprises:

a first cap flanged at its lower edge for gripping the collar of the neck of the bottle; p2 a supplementary cap comprising a pierceable foil extending along an inner surface of the first cap with a section of the inner foil facing the opening in the neck of the bottle, the foil extending to the lower edge of the first cap and being flanged with the first cap at the lower edge to provide a flange which grips the collar of the neck; and the foil section of the supplementary cap has a thickness enabling a puncturing of the foil section, and the first cap has a hole proving access to the foil section to establish a puncture a region of the covering, the foil being secured to the first cap by a formation of the edge burrs having an intermeshing of the foil of the supplementary cap with the flange of the first cap wherein the adherence attachment is present in the region of the lower edge of the first cap.

8. A container comprising an in fusion bottle having a neck, and a covering for closing off an opening in the neck, wherein the neck has a collar, and the covering has a lower edge configured for mating with the collar for securing the covering to the neck; and wherein the covering comprises;

a first cap flanged at its lower edge for gripping the collar of the neck of the bottle;

a supplementary cap comprising a pierceable foil extending along an inner surface of the first cap with a section of the foil facing of the opening in the neck of the bottle, the foil extending to the lower of the first cap and being flanged with the first cap at the lower edge to provide a flange which grips the collar of the neck; and the foil section of the supplementary cap has a thickness enabling a puncturing of the foil section, and the first cap has a hole providing access to the foil section to establish a puncture region of the covering, the foil being secured to the first cap by an attachment wherein the flange constitutes a two-layer edge which is bent-off, the supplementary cap being tapered towards an outer surrounding wall of the first cap.

* * * * *